United States Patent [19]

Estruch

[11] Patent Number: 4,481,683

[45] Date of Patent: Nov. 13, 1984

[54] REVERSIBLE UNI-SEX GARMENT

[75] Inventor: José Estruch, San Juan, P.R.

[73] Assignee: Fabrilmalla, Inc., Guaynabo, P.R.

[21] Appl. No.: 384,478

[22] Filed: Jun. 3, 1982

[51] Int. Cl.[3] ..... A41F 19/00

[52] U.S. Cl. ..... 2/400; 112/418

[58] Field of Search ..... 2/400, 67, 238, 406, 2/DIG. 2; 112/418, 419

[56] References Cited

U.S. PATENT DOCUMENTS 2,905,581 9/1959 Maxey ..... 2/400

4,372,998 2/1983 Shimada ..... 2/400

*Primary Examiner*—Doris L. Troutman

*Attorney, Agent, or Firm*—Kane, Dalsimer, Kane, Sullivan and Kurucz

[57] ABSTRACT

Disclosed are reversible pants which may be worn by both men and women.

2 Claims, 4 Drawing Figures

FIG.1
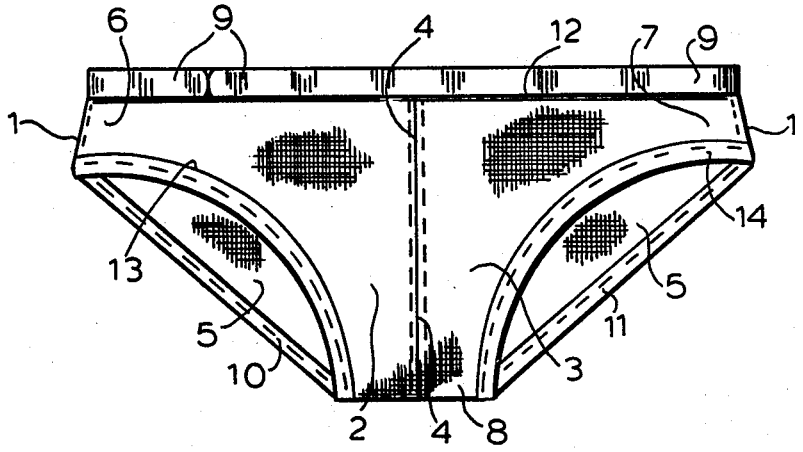
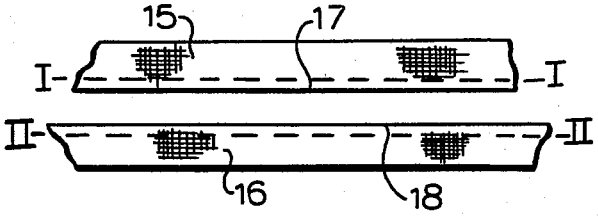
FIG.2
FIG.3
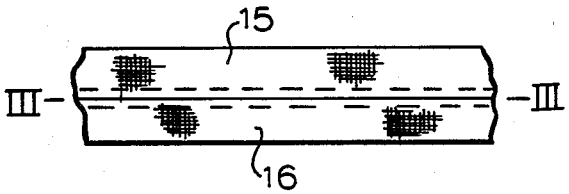
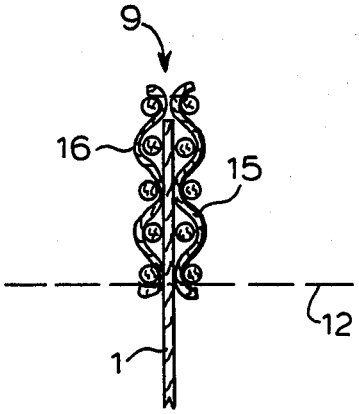
FIG.4

REVERSIBLE UNI-SEX GARMENT

BACKGROUND OF THE INVENTION

FIELD OF THE INVENTION

The invention relates to wearing apparel and more particularly it relates to reversible garments which may be worn by both men and women.

SUMMARY OF THE INVENTION

The invention comprises reversible pants, wearable by men or women which comprises;

a cloth body having a first planar surface and a second opposite planar surface, said cloth body being adapted by size and configuration to fit a male or female human being as pants;

said cloth body having a first peripheral edge corresponding to the waist of a wearer;

said cloth body having a second peripheral edge defining an aperture of the pants for receiving a leg of the wearer;

said cloth body having a third peripheral edge, defining an aperture of the pants for receiving a second leg of the wearer;

the first, second and third peripheral edges being finished with an elastic tape binding;

said binding comprising, two elastic bands, each band having at least one lengthwise edge, said bands being positioned to partially overlie edge to edge and secured together by stitching along each edge whereby a zone is formed between the stitching on each edge;

said binding being folded along the length of said zone, to form two edges thereof, between which the respective peripheral edges of the cloth body are located to form an elastic, totally flat binding of very little thickness.

BRIEF DESCRIPTION OF THE DRAWINGS

FIG. 1 is a front view of an embodiment garment of the invention whereby one can see two front panels joined together by a central flat seam.

FIG. 2 shows two bands of elastic which are shown placed laterally to be joined by seams extending along lines I—I and II—II of an edge of each band.

FIG. 3 shows the two bands of elastic shown in FIG. 2 now joined by a seam along lines III—III. The union has been made with a zig zag or chain stitch.

FIG. 4 is a cross-sectional, side elevation, enlarged to show detail of the elastic binding finishing the leg apertures of the garment shown in FIG. 1.

DETAILED DESCRIPTION OF THE PREFERRED EMBODIMENTS OF THE INVENTION

The garments of the invention are reversible for wear and may be worn comfortably by both men and women. By being reversible, it is meant that the garments of the invention have neither an inside or an outside but can be worn with each side as an outer or an inner side. One cannot distinguish an inner side or lining from the other side as an outer side when the garment is worn. The garments of the invention therefore are a new, reversible garment which can be used by ladies or by gentlemen, be it as feminine panties, men's briefs, trunks or the like. The garments have neither front nor back sides and can be made in an indefinite number of colors and prints or combinations of the same. They can be one color on one side and a print on the other, one color on each side or with different colors or prints on each side, etc. The garments of the invention can be manufactured from any type of textile cloth material conventionally used to manufacture prior art garments for the same uses.

In preferred embodiment garments of the invention, consideration has been given to the formation of the waist and the legs by finishing them using a special type of elastic binding which expands lengthwise only and which is formed by two elastic bands attached to each other by a center seam in such a manner that a lengthwise folding of the seamed elastic bands can be made easily. The middle of the elastic binding separates two equal band edges that are placed one on top of the other. The folding binding receives the peripheral edges of the garment body in such a manner that the elastic edge of each band is flat and without any thickness to discomfort the wearer. Thus, regardless of which side of the garment is turned to the outside the edges of the cloth body present a finished look, which is the same on each side.

Advantageously, the stitching of the elastic binding to the waist and leg portions of the garment is a zig zag or chain stitch. This type of stitching is strong, durable and comfortable to the wearer, while being somewhat decorative.

The other seams by which the garment of the invention is assembled are made with a flat seam sewing machine which seams are absolutely comfortable when the garment is worn, regardless of which side of the garment is used as the outside of the garment. The "uni-sex" garment conceived, has many and varied decorative forms and its manufacture is very simple. It can be manufactured in large quantities at relatively low costs.

A more complete understanding of the reversible, uni-sex garment of the invention may be obtained through a reading of the following description while viewing the accompanying drawings representing preferred details.

The FIG. 1 is a front view of a preferred embodiment garment 1 of the invention. The garment 1 consists of two front pieces 2 and 3 joined together along a central line 4 to form a seam which is sewn on a flat seam sewing machine. Any number of pieces can be seamed together in a like manner to form the cloth body of the garment 1. The pieces 2, 3 form the front part of the garment 1 which is joined with piece 5 (which forms the back side) along the sides and between the legs by the flat seams 6, 7 and 8. The garment 1 thus formed is finished by the application of a doubled binder tape 9 which is extended endlessly all along the peripheral edge of the top side of the pieces 2, 3 and 5. The binder tape 9 is advantageously an elastic doubled tape consisting of two elastic, collateral bands joined together by a central seam. The same type of binder tape is used in binding the leg aperture edges. As shown, doubled over elastic tapes 10 and 11 have been applied to bind and finish the leg aperture edges of the pieces 2, 5, and 3, 5. The joining of the waist binder tape 9 and of the elastic binder tapes 10 and 11 on the edges of the garment 1 was perfected by seams 12, 13 and 14, respectively.

FIG. 2 shows portions of elastic binder tape 9 (or 10 or 11). Each of the binder tapes 9, 10, 11 consist of two elastic bands 15 and 16 which may be the same or a different color or print. As shown in FIG. 2, the bands 15, 16 lie parallel to each other so that their adjacent edges 17 and 18 are in an overlying, abutable position all along their length. In finishing the garment 1, the two bands 15 and 16 are disposed together so that the edges 17, 18 contact and overlie each other. The bands 15, 16 are then permanently secured together by sewing along lines I—I and II—II as shown in FIG. 2. This permanent union of bands 15 and 16 form a center line III—III; see FIG. 3. With one band on top of the other forming the tapes 9, 10, 11 each binder tape has two free sides or edges for securing the binder tape along the edges of the waist and the legs of garment 1.

FIG. 4 is a cross-sectional, side elevation, enlarged to show details of the bands 15, 16 making up one of the tapes 9, 10 or 11 in finishing peripheral edges of the garment 1. From this FIG. 4 it can be seen that the doubled over elastic tape 9 (or 10 or 11) has been folded in the middle along the line III—III) to form two free sides or skirts in between which the corresponding peripheral edge of the garment 1 is placed. The structure results in an elastic binding which is totally flat with very little thickness. It is absolutely comfortable, regardless of which side is against the body of the wearer of garment 1. It is preferably incorporated in the garment 1 by a zig zag or chain type of stitching for appearance, durability and comfort.

Those skilled in the art will appreciate that many modifications of the above described preferred embodiment may be made without departing from the scope of the invention. For example, it should be understood that the elastic bands 15, 16 referred to herein can be manufactured in one piece, having a center folding line at which the band is folded to form the two edges between which the garment 1 edges are placed. It happens, however, that such is not the most desirable for garments having different colors or prints on each of the inner or outer sides.

I claim:

1. Reversible pants wearable by men or women which comprises;

a cloth body having a first planar surface and a second opposite planar surface, said cloth body being adapted by size and configuration to fit a male or female human being as pants;

said cloth body having a first peripheral edge corresponding to the waist of the wearer;

said cloth body having a second peripheral edge defining an aperture of the pants for receiving a leg of the wearer;

said cloth body having a third peripheral edge, defining an aperture of the pants for receiving a second leg of the wearer;

the first, second, and third peripheral edges being finished with an elastic tape binding;

said binding comprising two elastic bands, each band having at least one lengthwise edge, said tape being positioned to partially overlie edge to edge and secured together by stitching along each edge whereby a zone is formed between the stitching on each edge;

said binding being folded along the length of said zone, to form two edges thereof, between which the respective peripheral edges of the body are located to form an elastic, totally flat binding of very little thickness.

2. The pants of claim 1 wherein each band is color matched for the surface of the cloth body adjacent to it.

* * * * *